US006050316A

United States Patent [19]

Finke et al.

[11] Patent Number: 6,050,316

[45] Date of Patent: Apr. 18, 2000

[54] SINGLE FACER PREHEATER

[75] Inventors: Joseph L. Finke, Street; Kent W. Thurston, Timonium; Charles E. Thomas, Reistertown, all of Md.

[73] Assignee: United Container Machinery, Inc., Glen Arm, Md.

[21] Appl. No.: 09/105,968

[22] Filed: Jun. 26, 1998

Related U.S. Application Data

[63] Continuation-in-part of application No. 08/892,694, Jul. 15, 1997

[60] Provisional application No. 60/044,640, Apr. 18, 1997.

[51] Int. Cl.[7] ..... B31F 1/36; B31F 1/28

[52] U.S. Cl. ..... 156/472; 156/497; 156/499; 34/624; 34/639

[58] Field of Search ..... 156/205, 322, 156/470, 471, 472, 473, 469, 497, 499; 165/89, DIG. 159; 34/122, 583, 114, 624, 629, 639

[56] References Cited

U.S. PATENT DOCUMENTS

| | | | |
|---|---|---|---|
| 545,354 | 8/1895 | Ferres . | |
| 972,121 | 10/1910 | McPike et al. . | |
| 1,609,318 | 12/1926 | Smith . | |
| 2,638,962 | 5/1953 | Nitchie | 154/31 |
| 2,828,553 | 4/1958 | Jarosz | 34/122 |
| 3,319,353 | 5/1967 | Matsunami et al. | 34/155 |
| 3,340,125 | 9/1967 | Drenning et al. | 156/274 |
| 3,434,901 | 3/1969 | Griffiths et al. | 156/210 |
| 3,591,908 | 7/1971 | Pepmeier | 156/497 |
| 3,981,758 | 9/1976 | Thayer et al. | 156/64 |
| 4,268,341 | 5/1981 | Huhne | 156/353 |
| 4,310,375 | 1/1982 | Seki | 156/462 |
| 4,316,761 | 2/1982 | Hirakawa et al. | 156/472 |
| 4,337,884 | 7/1982 | Hirakawa et al. | 226/52 |
| 4,338,154 | 7/1982 | Berthelot et al. | 156/462 |
| 4,348,250 | 9/1982 | Bromley | 156/473 |
| 4,381,212 | 4/1983 | Roberts | 156/473 |
| 4,419,173 | 12/1983 | Akiyama et al. | 156/470 |
| 4,459,726 | 7/1984 | O'Brien et al. | 165/89 |
| 4,483,770 | 11/1984 | Casey et al. | 210/401 |
| 4,836,429 | 6/1989 | Nakashima et al. | 226/7 |
| 4,889,580 | 12/1989 | Seki et al. | 156/382 |
| 4,917,664 | 4/1990 | Lacaux | 493/470 |
| 4,932,139 | 6/1990 | Lehtinen | 34/41 |
| 4,947,559 | 8/1990 | Basler et al. | 34/70 |
| 5,110,396 | 5/1992 | Harris | 156/382 |
| 5,156,714 | 10/1992 | Thomas | 156/472 |
| 5,181,330 | 1/1993 | Schoch | 34/162 |
| 5,183,525 | 2/1993 | Thomas | 156/470 |
| 5,259,124 | 11/1993 | Poterala | 34/155 |
| 5,419,796 | 5/1995 | Miller | 156/207 |
| 5,449,431 | 9/1995 | Isowa | 156/472 |
| 5,480,086 | 1/1996 | Nakashima et al. | 226/97 |
| 5,495,092 | 2/1996 | Marschke et al. | 219/388 |
| 5,501,762 | 3/1996 | Marschke et al. | 156/470 |
| 5,614,048 | 3/1997 | Barny et al. | 156/205 |
| 5,628,865 | 5/1997 | Marschke | 156/473 |
| 5,630,903 | 5/1997 | Knorr et al. | 156/472 |
| 5,656,124 | 8/1997 | Krayenhagen et al. | 156/359 |
| 5,766,410 | 6/1998 | Wu | 156/472 |

FOREIGN PATENT DOCUMENTS

WO9816372 4/1998 WIPO .

*Primary Examiner*—Michael W. Ball
*Assistant Examiner*—Barbara Musser
*Attorney, Agent, or Firm*—Biebel & French

[57] ABSTRACT

A single facer including a preheater for conditioning a paperboard web. The preheater is positioned upstream form a corrugating nip and includes an arcuate surface facing the web. A plurality of primary channels are disposed internally within the preheater in thermal communication with the arcuate surface. High pressure steam is supplied to the primary channels for heating the arcuate surface. A plurality of outlet ports extend within the preheater and are in fluid communication with the heated arcuate surface. Low pressure steam is released through the plurality of outlet ports thereby producing a steam film between the heated arcuate surface and the paperboard web. The steam film dramatically increases heat transfer to the paperboard web while also reducing frictional forces opposing movement of the web.

20 Claims, 12 Drawing Sheets

28
82b
86b
82c
74
82d
86d
82e
26
74
82f
86f
98
8
82g
82h
86h
98
86t
16
98
90
82t
6
82s
86r
98
82r
124
8
82q
114
104
102
98
86p
82p
96f
96h
82a
104
110
96a
126
96b
94
96c
96d
96e
104
114
96g
82i
82j
98
86j
82l
86l
98
82m
82n
86n
82o
98
11
11

SINGLE FACER PREHEATER

CROSS-REFERENCE TO RELATED APPLICATION

This application is a continuation-in-part of U.S. patent application Ser. No. 08/892,694, filed Jul. 15, 1997, which claims the benefit of U.S. Provisional Application Ser. No. 60/044,640, filed Apr. 18, 1997.

The United States Government has a paid-up license in this invention and thee right in limited circumstances to require the patent owner to license others on reasonable terms as provided for by the terms of Award No. 70NANB6H2002 awarded by the U.S. Department of Commerce, National Institute of Standards and Technology.

BACKGROUND OF THE INVENTION

1. Field of the Invention

The present invention relates to an improved heating device for a continuous paperboard web, and more particularly, to a single facer preheater for simultaneously imparting heat and moisture to a medium paperboard web.

2. Description of the Prior Art

The manufacturing of double face corrugated paperboard typically begins with an apparatus known as a single facer. A conventional single facer includes a lower, or forming, corrugating roll and an upper, or carrier, corrugating roll wherein each corrugating roll has a plurality of longitudinally extending teeth. The corrugating rolls are rotatably mounted adjacent each other such that the teeth of each roll are in a meshing relationship. A paperboard medium web is fed into a corrugating nip defined between the lower and upper corrugating rolls wherein the medium web conforms to the contour of the meshing teeth to form flutes therein. Prior to feeding the medium web into the corrugating nip, the medium web is conditioned for reconfiguration, such conditioning typically including both preheating and steaming of the paperboard.

To preheat the medium web, a conventional preheater is supplied which typically comprises a steam pressurized drum having an internal cavity supplied with steam having a temperature about 370° F. at 185 psig. The medium web is wrapped around the outer circumference of the drum and the heat from the surface of the drum is transferred to the moving medium web to increase the temperature of the web. Next, the web is fed over a steam chamber positioned in spaced relation downstream from the preheater and upstream from the corrugating nip. The steam chamber injects steam directly against the paperboard medium web to loosen the paper fibers, such that the fibers are pliable and more easily formed.

A gluing roll, arranged to turn in a bath of starch-based glue, is positioned downstream from the corrugating nip and applies glue to the tips of the medium web flutes. The glue applied to the flutes of the medium web is typically a suspension of raw or uncooked starch in a suitable liquid carrier. In this state, the starch has little or no adhesive qualities. However, at a certain temperature, dependent upon the type of starch utilized and the kind and amount of additives dissolved in the carrier, the starch granules will absorb the available liquid of suspension and swell, causing gelatinization of the suspension. In this gelatinized state the starch has superior adhesion abilities and will form a good bond between many substrates, including paper. The temperature at which gelatinization occurs for any particular formulation of glue can be easily determined by heating the particular formulation and observing the changes that occur in its viscosity.

As glue is applied to the paperboard medium web, a paperboard liner web is simultaneously supplied to a preheater having a design similar to that of the medium web preheater. By preheating the webs and thereby increasing their temperatures, gelatinization of the glue and bond formation between the webs is facilitated. Both the liner web preheater and medium web preheater depend on conduction for heat transfer to the respective paperboard web. Conduction heat transfer is directly related to the surface area of the paperboard web contacting the preheater, the duration of such contact and the temperature gradient between the preheater and the web. In order to provide sufficient heat transfer, the web preheaters must therefore define a relatively large surface area and the processing speed of the single facer must be limited.

In an attempt to facilitate a larger preheater surface area contacting the web and therefore greater heat transfer, increased wrap angles of the web around the outer circumference of the preheater drum are often provided. However, frictional forces opposing the movement of the liner and medium webs are substantially increased the greater the wrap angle around the outer surface of the preheater. Such frictional forces generate tension within the webs, often resulting in web breakage. Prior art attempts to eliminate such problems generated by friction have resulted in complex mechanical arrangements including rotatable preheater drums and variable wrap mechanisms.

As noted above, a disadvantage of the conventional drum heater is thermal inefficiency, often resulting in a preheater drum of relatively large size. In fact, such preheaters must often be placed, exterior to, and typically behind, the corrugating apparatus because of their size. Due to this position, there is a considerable distance between the heating drum and the steam chamber, and the paper is cooled during the travel therebetween, thereby further reducing the overall thermal efficiency of the preheating process.

Accordingly, there is a need for a single facer including a preheater which substantially increases the preheated temperature of the medium paperboard web, thereby facilitating rapid gelatinization of the glue between the medium and liner paperboard webs. Further, there is a need for such a preheater which significantly reduces the frictional forces opposing movement of the paperboard web.

SUMMARY OF THE INVENTION

The present invention provides a single facer including a web preheater for facilitating improved conditioning of a paperboard web while reducing frictional contact opposing movement of the web passing over the preheater.

The single facer of the present invention includes a forming corrugating roll defining a corrugating nip for corrugating flutes on a medium paperboard web. A carrier corrugating roll is operably connected to the forming corrugating roll for carrying the medium web into contact with a liner web. The preheater of the present invention is positioned upstream from the corrugating nip and includes a heated arcuate surface facing the medium web. A plurality of primary channels are disposed internally within the preheater in close proximity to and in thermal communication with the arcuate surface. A first steam inlet port is provided in fluid communication with the plurality of primary channels for providing a high pressure steam thereto. Heat released from the high pressure steam is conducted through the preheater for heating the arcuate surface which, in turn, transfers heat to the paperboard medium web.

A plurality of outlet ports extend within the preheater and are in fluid communication with the heated arcuate surface. A second steam inlet port is provided in fluid communication with the plurality of outlet ports for providing a low pressure steam thereto. The low pressure steam is released through the plurality of outlet ports thereby producing a steam film between the heated surface and the medium web. The steam film substantially reduces frictional forces between the heating plate and the medium paperboard web. Additionally, the steam film dramatically increases the amount and rate of heat transfer to the paperboard medium web such that the web has a greatly increased temperature when glue is applied to its exposed flute tips. As such, gelatinization of the glue is dramatically accelerated, facilitating a quicker and stronger initial bond between the medium and liner paperboard webs.

Therefore, it is an object of the present invention to provide a single facer preheater which increases the rate of heat transfer to a medium paperboard web thereby increasing the temperature of the web.

It is a further object of the present invention to provide such a single facer preheater which improves glue curing times between the medium paperboard web and a liner paperboard web.

It is yet another object of the present invention to provide a single facer preheater which simultaneously heats and supplies moisture to a paperboard medium web in preparation of flute formation.

It is an additional object of the present invention to provide a single facer preheater which substantially reduces frictional forces opposing movement of a paperboard web passing thereover.

Other objects and advantages of the invention will be apparent from the following description, the accompanying drawings and the appended claims.

DETAILED DESCRIPTION OF THE PREFERRED EMBODIMENT

Figure 1:
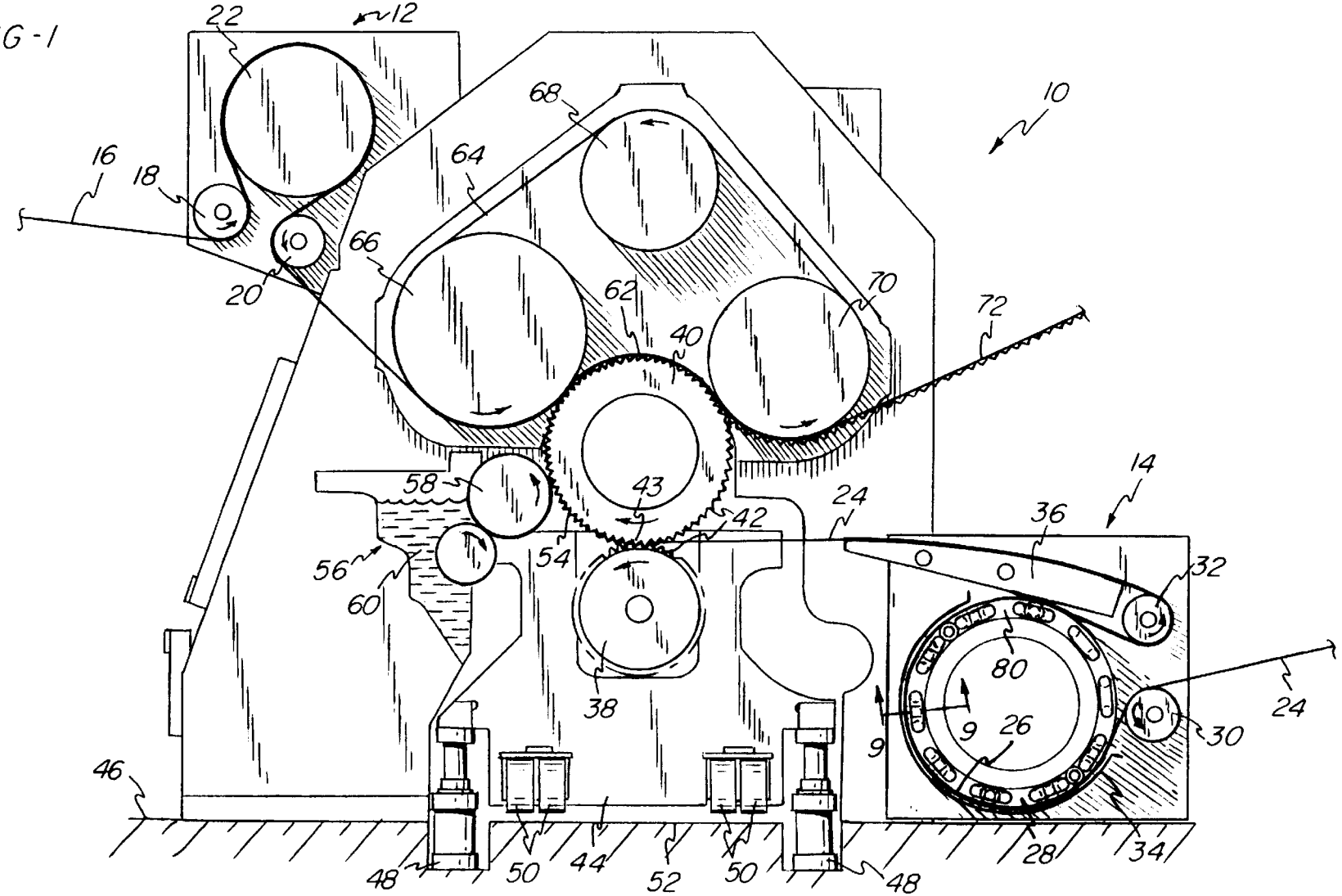
FIG. 1 is a side schematic view of a single facer of the present invention.

Referring initially to FIG. 1, a single facer 10 of the present invention is shown as including a liner web conditioning station 12 and a medium web conditioning station 14. A liner web 16 is supplied from a web feeding source (not shown), assumed to be on the left hand side of FIG. 1, to the liner web conditioning station 12 which includes a pair of rotatably mounted idler rolls 18 and 20 for drawing the liner web 16 around a preheater drum 22. The preheater drum 22 has an internal cavity supplied with high pressure steam for transferring heat to the outer surface of the drum 22 and subsequently to the liner web 16.

A medium web 24 is supplied from a web feeding source (not shown), which is assumed to be on the right hand side of FIG. 1, to the medium web conditioning station 14. Within the conditioning station 14, the medium web 24 is wrapped around an arcuate outer surface 26 of a preheater 28 of the present invention. A rotatably mounted idler roll 30 in combination with a rotatably mounted driven roll 32 guides the medium web 24 around the preheater 28. An arcuate guide 34 is concentrically disposed relative to the outer arcuate surface 26 of the preheater 28 and facilitates positioning the medium web 24 in close proximity to the preheater 28 during the threading of a leading edge of the web 24. The medium web 24 is further guided from the driven roll 32 over a steam chamber 36. The steam chamber 36 is of conventional design and includes a plurality of nozzles which inject steam directly against the medium web 24 to assist in moistening and loosening the paper fibers of the medium web 24. The steam chamber 36 is preferably located in vertical alignment with the preheater 28 such that a compact conditioning station 14 is provided within the single facer 10.

Referring further to FIG. 1, the single facer 10 further includes a first, or forming, corrugating roll 38 operably connected to a second, or carrier, corrugating roll 40. Both corrugating rolls 38 and 40 include longitudinally extending teeth 42 formed on their respective circumferences. The corrugating rolls 38 and 40 are rotatably supported such that the teeth 42 of the carrier corrugating roll 40 are engagable with the teeth 42 of the forming corrugating roll 38 via the paperboard medium web 24, thereby defining a corrugating nip 43.

The corrugating rolls 38 and 40 are rotatably supported by a movable frame 44 which may be raised or lowered relative the floor 46 by hydraulic cylinders 48. More particularly, during operation of the single facer 10 the movable frame 44 is held in a raised position by the cylinders 48. The frame 44 may be lowered by the cylinders 48 such that a plurality of wheels 50 connected to the frame 44 are positioned in engagement with the floor 46. As may be appreciated, the movable frame 44 and corrugating rolls 38 and 40 are thereafter supported by the wheels 50 and may be readily rolled out of the operating area of the single facer 10. A different movable frame may thereafter be rolled into proper position within the single facer 10 such that the corrugating rolls 38 and 40 may be readily interchanged with other corrugating rolls.

The medium web 24 is supplied from the medium conditioning station 14 to the corrugating nip 43 defined between the teeth 42 of the forming and carrier corrugating rolls 38 and 40 for forming predetermined flutes 54 within the medium web 24. A glue applicator 56 is disposed diagonally below the carrier corrugating roll 40. The glue applicator 56 is of conventional design and consists of a glue roll 58 rotatably supported to turn within a bath of glue 60 in response to rotation of the carrier corrugating roll 40. The medium web 24 is glued at its flutes 54 by the glue applicator 56 and is then carried upwardly along the outer circumference of the carrier corrugating roll 40 into contact with the liner web 16. The medium web 24 may be held against the carrier corrugating roll 40 proximate the glue applicator 56 through either positive air pressure or a vacuum in a manner well known in the art.

The liner web 16 is fed from the liner conditioning station 12 to a bonding nip 62 defined between the carrier corrugating roll 40 and a pressing device, preferably a pressure belt 64. The pressure belt 64 is supported for movement around a plurality of rotatably supported belt rolls 66, 68 and 70. The bonding nip 62 created by the pressure belt 64 presses the liner web 16 into adhering contact with the glued flutes 54 of the medium web 24, thereby forming a single face paperboard web 72. The single face web 72 then exits the single facer 10 to the right side of FIG. 1 for additional processing.

Figure 2:
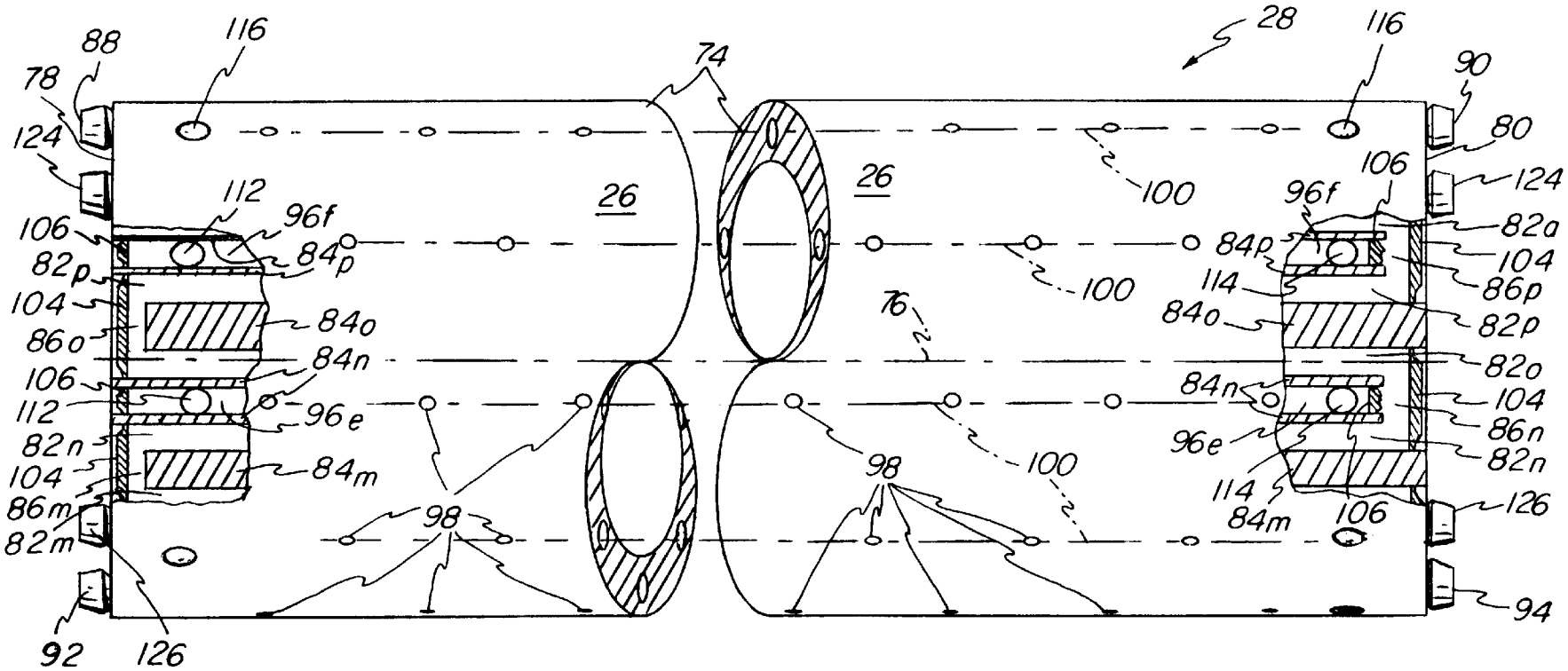
FIG. 2 is a side elevational view of the preheater of FIG. 1 with a partial cutaway to show the internal structure.
Figures 3, 4:
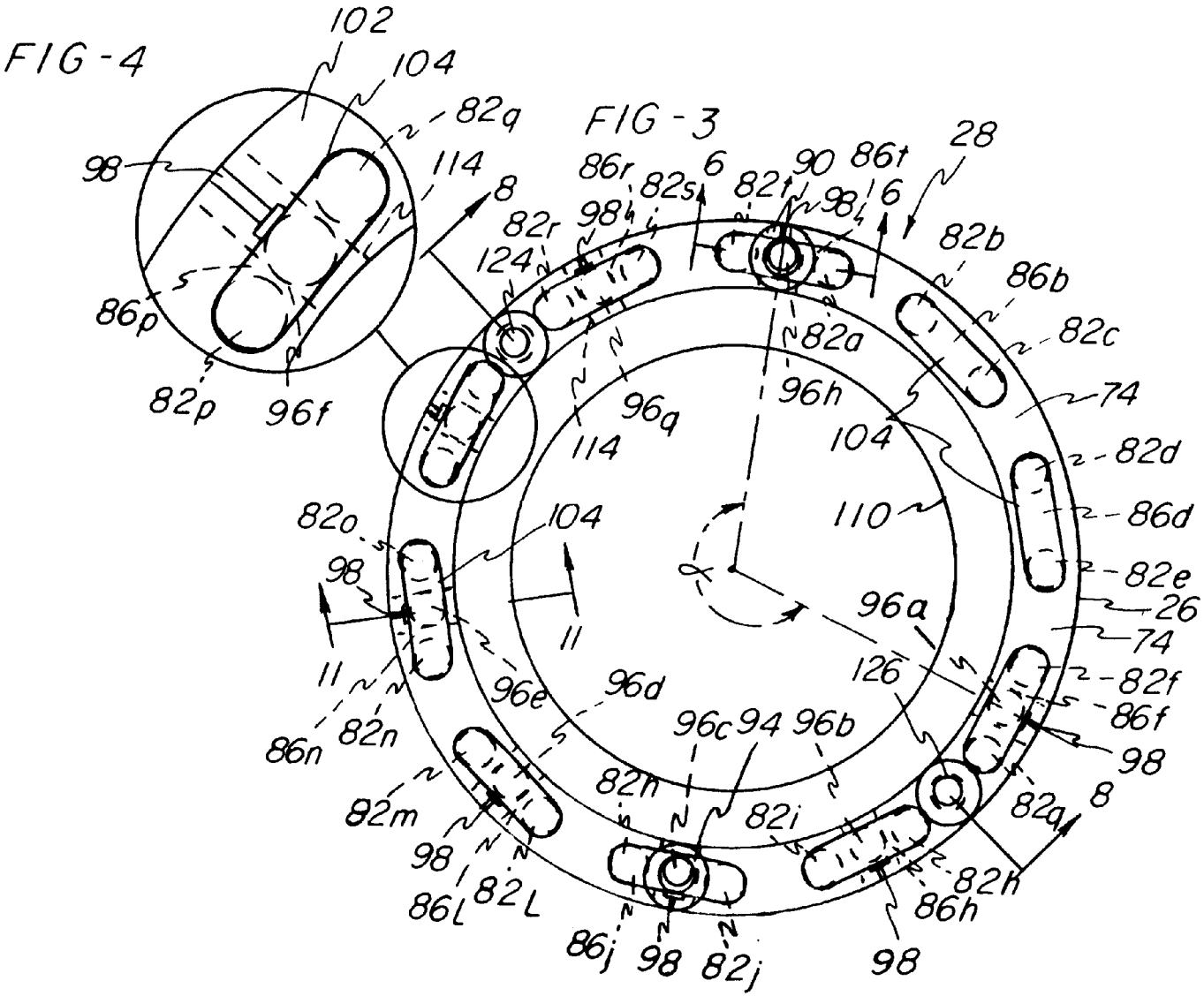
FIG. 3 is a right end view of the preheater of FIG. 2.
FIG. 4 is a detail view of FIG. 3.

Turning now to FIGS. 2–4, the preheater 28 will be described in greater detail. The preheater 28 includes a cylindrical wall 74 extending concentrically about a center axis 76 between opposing end faces 78 and 80. The cylindrical wall 74 is preferably comprised of carbon steel, although other known materials having suitable thermal conductivity properties may be readily substituted therefore. The cylindrical wall 74 defines the heated arcuate outer surface 26 facing the medium web 24. In the preferred embodiment, the arcuate outer surface 26 extends approximately 100 inches between the end faces 78 and 80 and has an outer diameter of approximately 19 inches.

A plurality of primary channels 82 extend within the cylindrical wall 74 between the opposing end faces 78 and 80. The primary channels 82 are positioned to be in thermal communication with the outer surface 26 of the preheater 28. In the preferred embodiment of the invention, the primary channels 82 are cylindrical in nature and define walls 84 extending between adjacent primary channels 82. Slots 86 are included at alternate opposite end faces 78, 80 to interconnect adjacent primary channels 82 and form a serpentine path through the cylindrical wall 74. While the primary channels, walls, and slots are referred to generally by the reference numerals 82, 84 and 86, a particular item will be referred to by the respective reference numeral in combination with a lowercase letter, as more clearly shown in FIG. 2. It should be noted that in the preferred embodiment of the preheater 28, a total of 20 primary channels 82 are circumferentially disposed in equal spaced relation to each other within the cylindrical wall 74 (FIGS. 3 and 5).

Referring further to FIGS. 2–5, slot 86*m* is included at end face 78 of the cylindrical wall 74 to interconnect primary channels 82*m* and 82*n*. At the opposite end face 80, slot 86*n* interconnects the primary channels 82*n* and 82*o*. As may be readily appreciated, each pair of adjacent primary channels 82 are interconnected at alternate end faces 78, 80 to form a serpentine path through the cylindrical wall 74.

Figure 6:
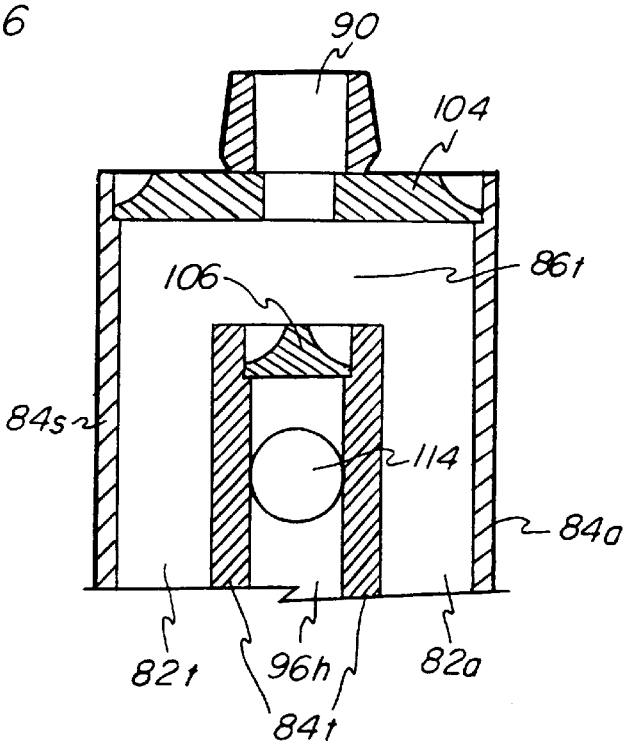
FIG. 6 is a cross-sectional view taken along line 6—6 of FIG. 3.

The preheater 28 further includes a pair of first, or high pressure, steam inlet ports 88 and 90, each extending axially outwardly from one of the end faces 78 and 80. Turning now to FIGS. 3 and 6, each high pressure steam inlet port 88 and 90 is located intermediate, and in fluid communication with, a pair of primary channels 82 for supplying high pressure steam from an external source (not shown). In the preferred embodiment, only a single high pressure inlet port 88 and 90 is supplied with high pressure steam, while the other high pressure inlet port 90 and 88 is provided for flexibility in connecting to external steam piping.

Figure 5:
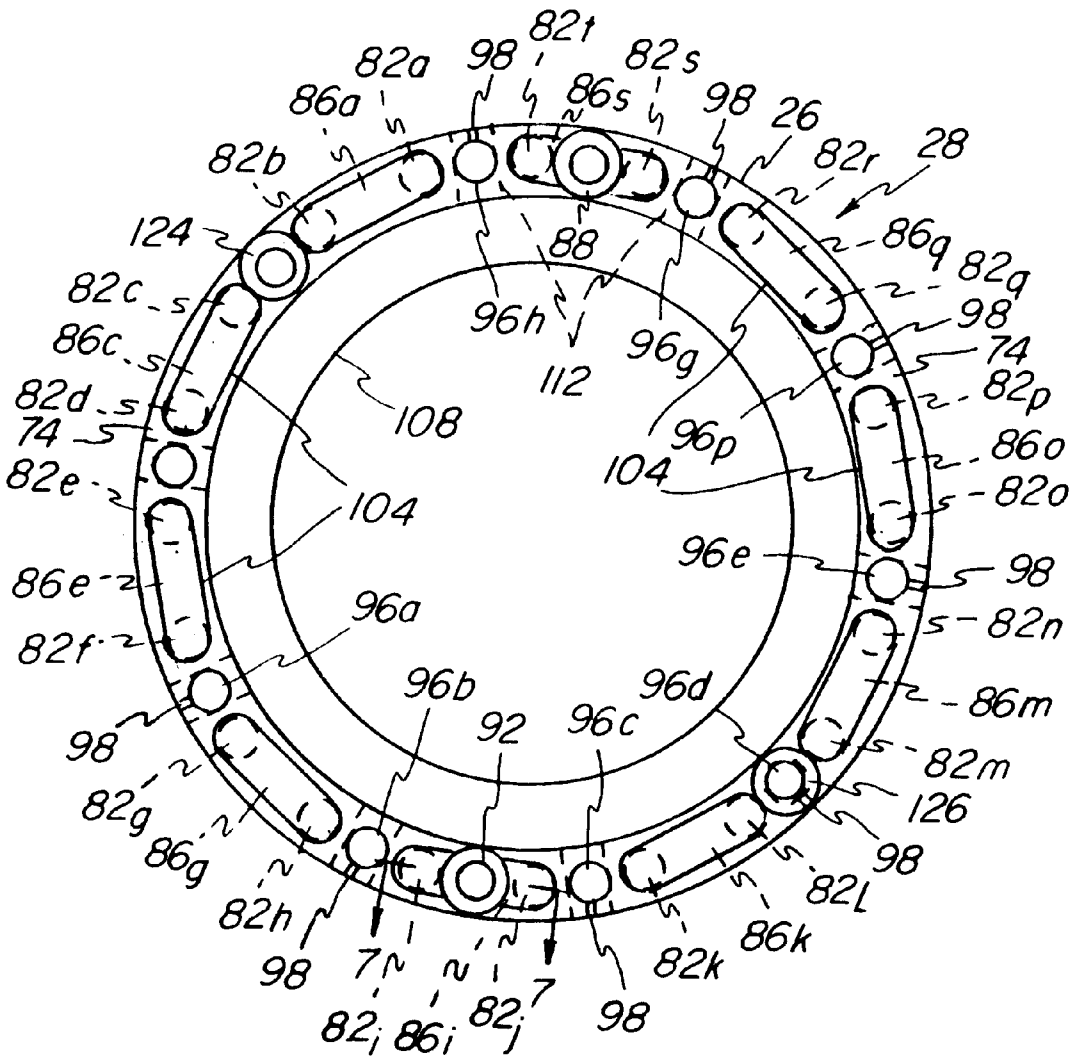
FIG. 5 is a left end view of the preheater of FIG. 2.
Figure 7:
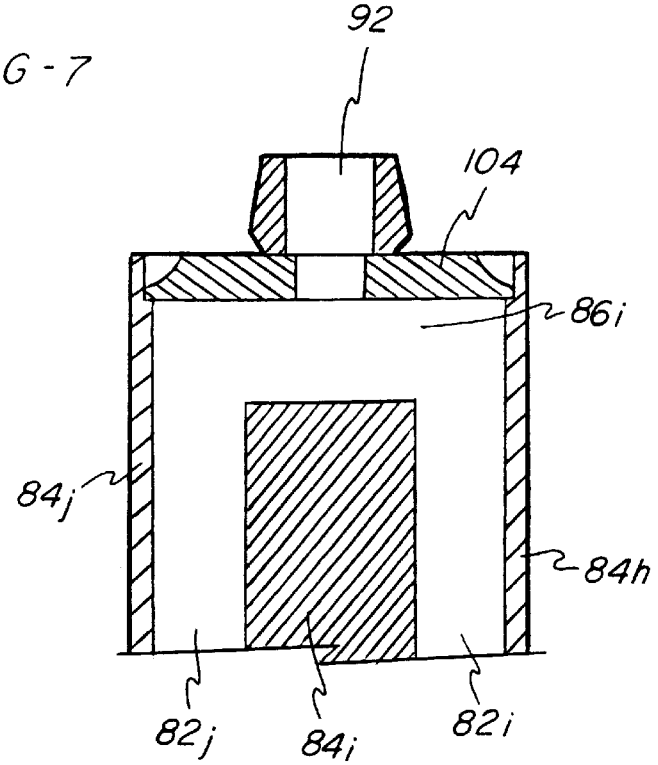
FIG. 7 is a cross-sectional view taken along line 7—7 of FIG. 5.

Referring further to FIGS. 3, 5 and 7, the preheater 28 further includes a pair of first, or high pressure, condensate return ports 92 and 94 positioned intermediate, and in fluid communication with a pair of primary channels 82. As with the high pressure steam inlet ports 88 and 90, the first condensate return ports 92 and 94 extend axially outwardly from the end faces 78 and 80. However, the condensate return ports 92 and 94 are positioned at a lower extremity of the preheater 28 to facilitate the gravitational discharge of condensate. It may be appreciated that as high pressure steam is supplied to one of the high pressure inlet ports 88 and 90, the high pressure steam travels through the serpentine path defined by the plurality of primary channels 82 and transfers its heat through the cylindrical wall 74 to the outer surface 26 of the preheater 28. As the high pressure steam releases its heat, a portion of the steam will turn into condensate which exits through one of the first condensate return ports 92 and 94.

Returning to FIGS. 2–5, the preheater 28 further includes a plurality of secondary channels 96 extending within the cylindrical wall 74 in substantially parallel relation to the primary channels 82. The secondary channels 96 are circumferentially disposed in equal spaced relation to each other within the cylindrical wall 74. The secondary channels 96 are cylindrical in nature and each secondary channel 96 is sealed from the other primary and secondary channels 82 and 96. As with the primary channels 82, a particular secondary channel 96 will be referred to by a reference numeral in combination with a lowercase letter.

Referring further to FIG. 3, a total of eight secondary channels are preferably disposed within the cylindrical wall 74. It should be noted that the first secondary channel 96*a* and last secondary channel 96*h* define an arc having an angle a, which preferably is equal to approximately 260°. The angle a is selected to be approximately equal to the maximum wrap angle of the medium web 24 around the outer surface 26 of the preheater 28 as defined by rolls 30 and 32 (FIG. 1). In the preferred embodiment, the secondary channels 96 are formed within every other wall 84 which separate circumferentially adjacent primary channels 82.

Turning again to FIGS. 2–5, a plurality of outlet ports 98 are in fluid communication with the secondary channels 96 and extend radially outwardly into fluid communication with the outer surface 26. The outlet ports 98 are arranged in axially, or laterally, extending rows 100 extending in substantially parallel relation to the secondary channels 96. The outlet ports 98 of each row 100 are equally spaced from each other and intersect a single secondary channel 96. Each row 100 of outlet ports 98 is circumferentially, or longitudinally, offset from each adjacent row 100 in a direction of travel of the medium web 24. It may be readily appreciated that since the secondary channels 96 extend approximately 260° around the outer surface 26 of the cylindrical wall 74, the outlet ports 98 likewise extend approximately 260° around the outer surface 26 of the cylindrical wall 74. As illustrated in FIG. 2, the outlet ports 98 of adjacent rows 100 are offset laterally in order to provide a substantially uniform steam distribution along the outer surface 26.

The outlet ports 98 are preferably of 0.125-inch diameter and arranged within each row 100 on 6-inch centers. In the preferred embodiment of the invention, both the primary and secondary channels 82 and 96 are formed by drilling axially through the cylindrical wall 74 between the opposite end faces 78 and 80. The primary channels 82 are drilled axially through the cylindrical wall 74 proximate the outer surface 26, thereby defining a thin web of material 102 between each primary channel 82 and the outer surface 26 (FIG. 4). The secondary channels 96 are likewise drilled axially through the cylindrical wall 74 preferably through alternating walls 84 which separate adjacent primary channels 82. The outlet ports 98 are drilled radially from the outer surface 26 of the cylindrical wall 74 to intersect the secondary channels 96. In order to seal the interconnection between the primary channels 82, end caps or plates 104 are placed within the slots 86, only partially filling the void created by the slots 86, and are preferably welded to the adjacent walls 84 proximate the end faces 78 and 80. Likewise, end caps or plates 106 are positioned at opposing ends of the secondary channels 96 and preferably welded to the adjacent walls 84 proximate the end faces 78 and 80.

First and second arcuate manifolds 108 and 110 are positioned proximate the end faces 78 and 80 and are concentrically disposed inside the cylindrical wall 74. Each arcuate manifold 108 and 110 defines an internal chamber 111 (FIG. 8) which is in fluid communication with the secondary channels 96 through a plurality of radially extending ports 112 and 114. The ports 112 and 114 are preferably disposed at opposing ends of the each secondary channel 96 proximate the end faces 78 and 80. The ports 112 and 114 are preferably formed by drilling radially through the cylindrical wall 74 to intersect the chamber 111 of a respective manifold 108 and 110. Plugs 116 are then welded to the cylindrical wall 74 proximate the outer surface 26 to seal the interconnection between the chamber 111 and the secondary channels 96 through the ports 112 and 114.

Figure 8:
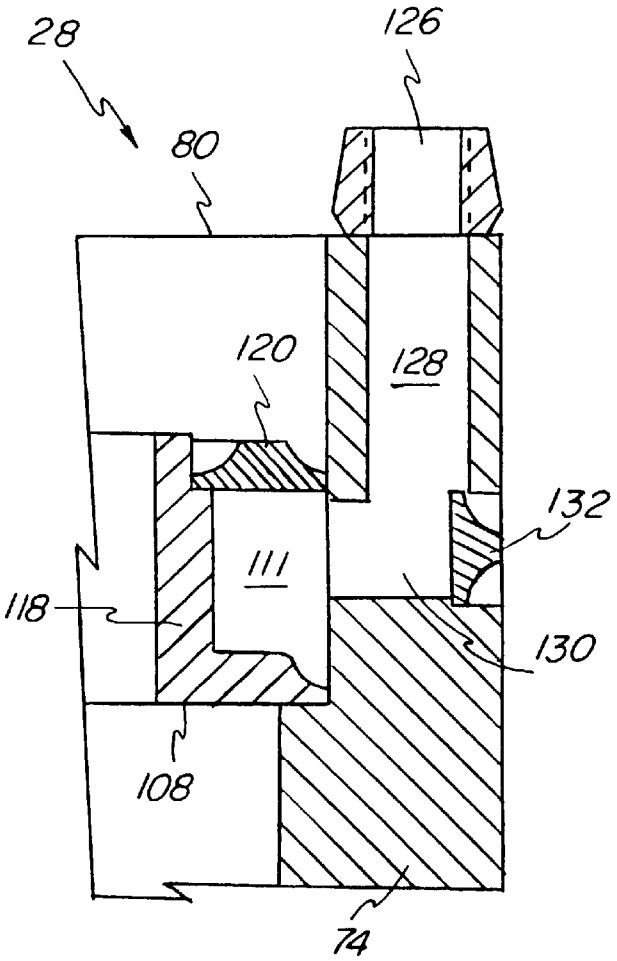
FIG. 8 is a cross-sectional view taken along line 8—8 of FIG. 3.
Figure 8:
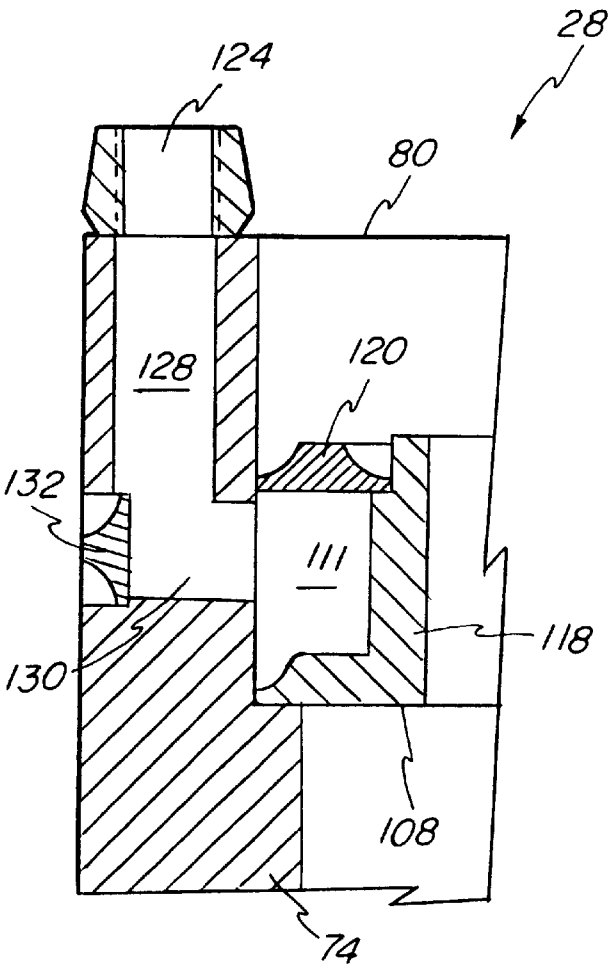

Turning now to FIGS. 3 and 8, each arcuate manifold 108 and 110 includes a first annular ring 118 fixed, preferably by welding, to the cylindrical wall 74. A second annular ring 120 is disposed proximate a respective end face 78 and 80 and is welded between the first annular ring 118 and the cylindrical wall 74. As illustrated in FIG. 8, the first and second rings 118 and 120 in combination with the cylindrical wall 74 define the internal chamber 111 which essentially has a torodial shape. The chamber 111 of each manifold 108 and 110 is in fluid communication with a pair of second, or low pressure, steam inlet ports 124 and 126. Each inlet port 124 and 126 extends axially outwardly from one of the end faces 78 and 80 and provides fluid communication to one of the manifolds 108 and 110 through an L-shaped passageway comprising first and second channels 128 and 130. It should be noted that both channels 128 and 130 are formed by drilling into the cylindrical wall 74. Channel 128 extends axially through the cylindrical wall in substantial parallel relationship to the center axis 76 while the second channel 130 extends radially inwardly from the outer surface 26. A plug 132 similar to plug 116 used to seal the ports 112 and 114, is used to seal the interconnection between channels 128 and 130.

Next, the operation of the single facer 10 of FIGS. 1–8 will be described in greater detail. Referring initially to FIG. 1, the liner web 16 is supplied to the single facer 10 and wrapped around conventional preheater drum 22 by the pair of idler rolls 18 and 20. Simultaneously, the medium web 24 is wrapped around the heater 28 by idler roll 30 and driven roll 32. Each primary channel 82 of preheater 28 is supplied with high pressure saturated steam at approximately 185 psig at 375° F. More particularly, the high pressure saturated steam is supplied to one of the first inlet ports 88 and 90 such that the steam travels through the serpentine path defined by the plurality of primary channels 82. The steam releases thermal energy to the outer surface 26 by way of the cylindrical wall 74 while condensate exits through one of the first condensate return ports 92 and 94. While 185 psig is the preferred pressure for the high pressure steam supplied to the primary channels 82, the high pressure steam may possess a pressure within a wide range about 185 psig, but preferably between 160 psig and 200 psig.

Figure 9:
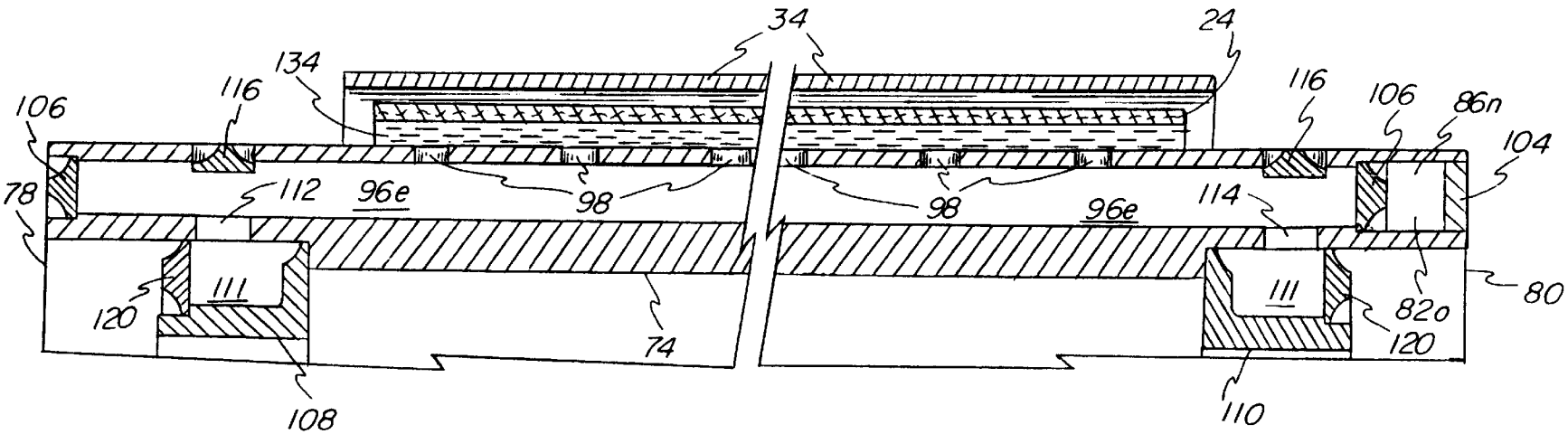
FIG. 9 is a cross-sectional view taken along line 9—9 of FIG. 1.

Low pressure steam at approximately 0.6 psig is supplied to the pair of second inlet ports 124 and 126 in communication with each arcuate manifold 108 and 110. Referring now to FIG. 9, the low pressure steam travels within the arcuate manifolds 108 and 110 through the ports 112 and 114 and into opposing ends of the secondary channels 96. The low pressure steam travels through the secondary channels 96 and exits through the plurality of outlet ports 98. The low pressure steam exiting the outlet ports 98 produces a steam film 134 between the medium web 24 and the outer surface 26 of the heater 28. The steam film 134 supports the medium web 24 and thereby reduces frictional contact between the web 24 and the outer surface 26 of the cylindrical wall 74.

As readily apparent, the pressure of the low pressure steam within the secondary channels 96 is of several orders of magnitude less than the pressure of the high pressure steam within the primary channels 82. High pressure steam is not appropriate for the secondary channels 96, since such high pressure steam would exit through the outlet ports 98 at a high velocity and cause damaging contact with the web 24. The low pressure steam is preferably within the range of 0.25 psig and 5 psig, the actual pressure selected being directly related to the size and number of outlet ports 98 for producing steam film 134. More particularly, the steam film 134 must be adequate to support a web 24 wherein the thickness of the steam film 134 is a function of the size and number of outlet ports 98.

The high pressure steam within the primary channels 82 is at a higher temperature than the low pressure steam within the secondary channels 96. Heat will therefore transfer through the cylindrical wall 74 from the primary channels 82 to the secondary channels 96, thereby raising the temperature of the low pressure steam therein. The low pressure steam may be superheated by this heat transfer since its pressure remains substantially constant and its temperature is raised above its vapor temperature for that constant pressure.

In the preferred embodiment, the low pressure steam is already superheated when it is supplied to the secondary channels 96. More particularly, a saturated steam at a high pressure of approximately 185 psig is throttled by passing the steam through a valve (not shown) thereby reducing the pressure of the steam to approximately 0.6 psig. Throttling causes the temperature of the steam to drop somewhat, but the temperature of the resulting low pressure steam is still higher than that of saturated steam at the corresponding pressure of 0.6 psig (214° F.). Superheating increases the internal energy within the low pressure steam thereby increasing the potential heat transfer to the medium web 24.

Returning now to FIG. 1, after exiting the preheater 28, the medium web 24 is wrapped around driven roll 32 and passes over the steam injector 36. The steam injector 36 further conditions the web 24 by injecting steam directly against its lower surface whereby moisture results in the fibers of the paperboard becoming more pliable. It is believed that in many instances the steam injector 36 may be eliminated from the medium web conditioning station 14 due to the steam film 134 produced by the preheater 28 of the present invention. The steam film 134 should provide sufficient moisture to the medium web 24 in most instances such that further conditioning of the web by the steam injector 36 will be unnecessary.

With the medium web 24 heated and conditioned by the preconditioning station 14, the fibers of the medium web are somewhat loosened and softened and are thereafter fed into the corrugating nip 43 defined between the forming and carrier corrugating rolls 38 and 40. The medium web 24 is reshaped into flutes 54 having substantially the same configuration as the teeth 42 of the corrugating rolls 38 and 40. The corrugated medium web 24 is carried by the carrier corrugating roll 40 into engagement with the glue applicator 56 where adhesive is applied to the tips of the flutes 54 by the rotating glue roll 58.

The liner web 16 is wrapped around a preheater 22 by idler rolls 18 and 20 within the conditioning station 12 where the liner web is preheated. The liner web 16 is then fed into the pressure nip 62 defined between the pressure belt 64 and carrier corrugating roll 40. The corrugated medium web 24 and the liner web 16 are merged at the pressure nip 62 and due to the stored thermal energy within the webs 16 and 24, as well as heat supplied by the heated carrier corrugating roll 40, in combination with pressure exerted by the pressure belt 64, the adhesive between the webs 16 and 24 is caused to gelatinize and form the single face corrugated paperboard web 72.

Through experimentation, it has been unexpectedly discovered that the steam film 134 produced by the preheater 28 significantly accelerates the rise in temperature of the paperboard web 24, and results in a higher preheated temperature of the web 24 as compared to the prior art preheaters which rely on inherently poor thermal conduction between a heated surface and the paperboard web 24. This result is particularly noticeable when heating heavyweight paperboard. By increasing the temperature of the web 24 entering the bonding nip 62, the steam film 134 dramatically improves the heating and gelatinization times of the glue between the paperboard webs 16 and 24. Thus, processing speeds of the corrugating equipment may be increased since the paperboard webs 16 and 24 do not require long heat transfer time periods at the preheater 18 or the bonding nip 62. Furthermore, the steam film 134 facilitates the processing of multi-walled paperboard webs.

It is believed that the significant benefits resulting from the use of the steam film 134 are a result of a mass transfer process including the absorption and condensation of steam in the paper. A large quantity of thermal energy is released upon the condensation of the steam giving rise to the observed increased temperature of the preheated medium web 24 and accelerated gelatinization times of the glue.

The steam film 134 produced by the preheater 28 of the present invention also significantly reduces the friction between the web 24 and the outer surface 26 of the preheater 28. The reduced friction results in less drag opposing movement of the web 24 thereby reducing the power required to convey the web 24. Further, since frictional forces opposing web movement produce tension within the web 24, reduced friction results in less tension within the web 24, thereby resulting in reduced occurrences of web breakage or tear-outs.

Figure 10:
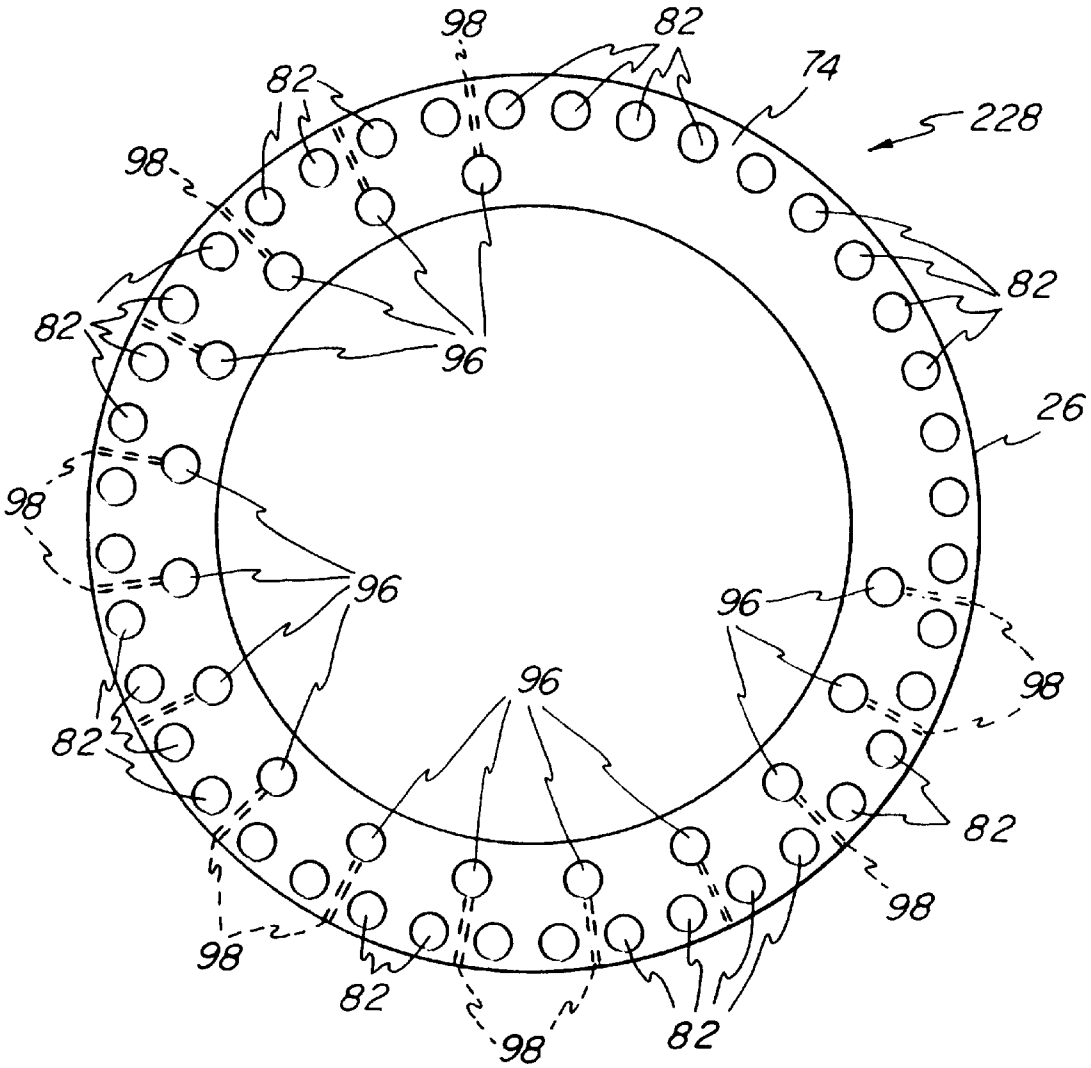
FIG. 10 is a right end view of an alternative embodiment of the preheater of the present invention.
Figure 11:
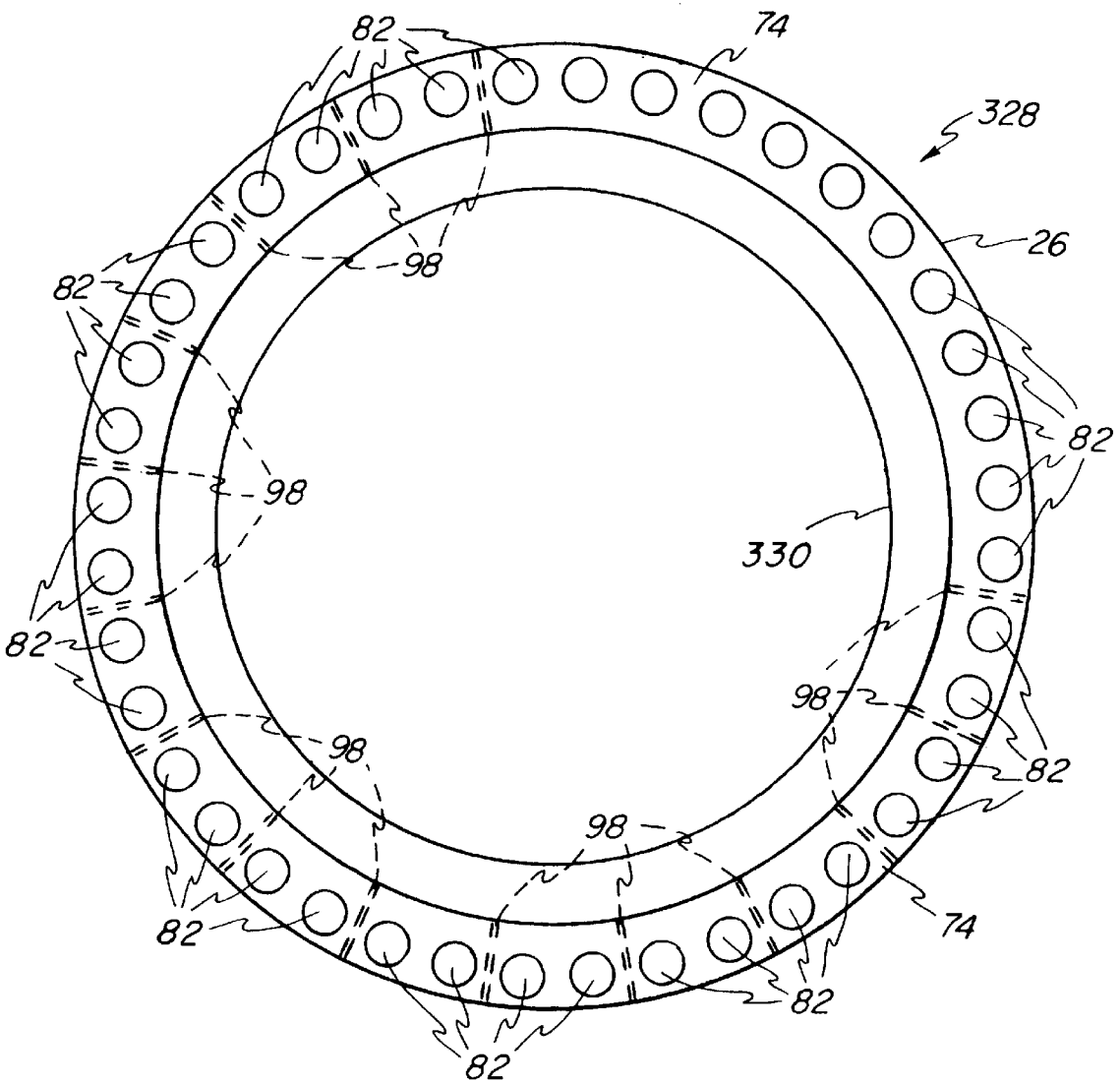
FIG. 11 is a right end view of a further embodiment of the preheater of the present invention.
Figure 12:
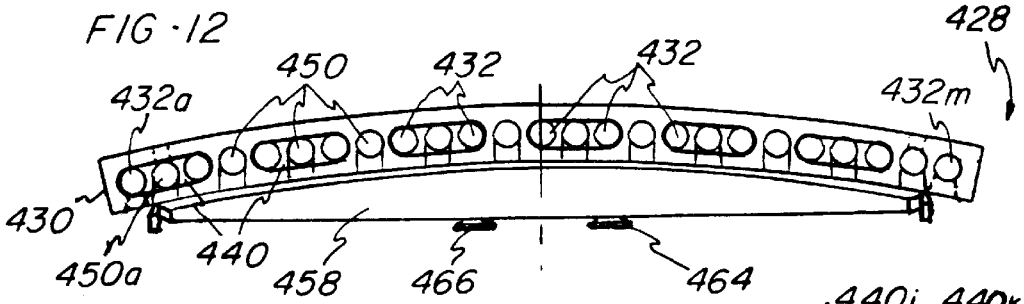
FIG. 12 is a side elevational view of a further embodiment of the preheater of the present invention.

FIGS. 10 and 11 illustrate alternative embodiments of the preheater 28 of the present invention. In the following description, like reference numerals identify similar components as identified above. Referring now to the embodiment of FIG. 10, the preheater is represented by reference numeral 228 and includes a plurality of parallel primary and secondary channels 82 and 96, respectively, extending axially within a cylindrical wall 74. However, unlike the embodiment of FIGS. 2–9, the secondary channels 96 are radially offset inwardly from the primary channels 82. As such, the primary channels 82 may be positioned closer to each other, thereby providing a greater number of primary channels 82 within the cylindrical wall 74. Of course, the larger the number of primary channels 82, the greater the potential for heat transfer to the arcuate surface 26 of the heater 228. As may be readily appreciated, the particular placement of the primary and secondary channels 82 and 96 relative to each other may be varied greatly depending upon operating conditions and properties of the paperboard web and glue.

Turning now to FIG. 11, preheater 328 includes a plurality of circumferentially disposed, evenly spaced primary channels 82 extending axially within cylindrical wall 74. However, instead of the fluid ports 98 communicating with a plurality of secondary channels as in the embodiment of FIGS. 2–9, the outlet ports 98 instead communicate directly with a single axially extending manifold 330. As with the embodiment of FIG. 10, preheater 328 provides for the close positioning of adjacent primary channels 82 thereby facilitating increased heat transfer to the arcuate outer surface 26.

Turning now to FIGS. 12–15, preheater 428 represents a further embodiment of the present invention and includes a curved plate 430. As with the embodiment of FIGS. 2–9, the curved plate 430 defines an arcuate outer surface 431 and includes a plurality of primary channels 432 extending along a longitudinal length of the plate 430 between opposing end faces 434 and 436. The primary channels 432 are cylindrical in nature and form walls 438 between each adjacent primary channel 432. Slots 440 are included at alternate opposite ends to interconnect adjacent primary channels 432 thereby forming a serpentine path through the plate 430. While the primary channels, walls and slots are referred to generally by the reference numerals 432, 438 and 440, a particular item will be referred to by the reference numeral in combination with a lowercase letter, as more clearly shown in FIG. 13.

Figure 13:
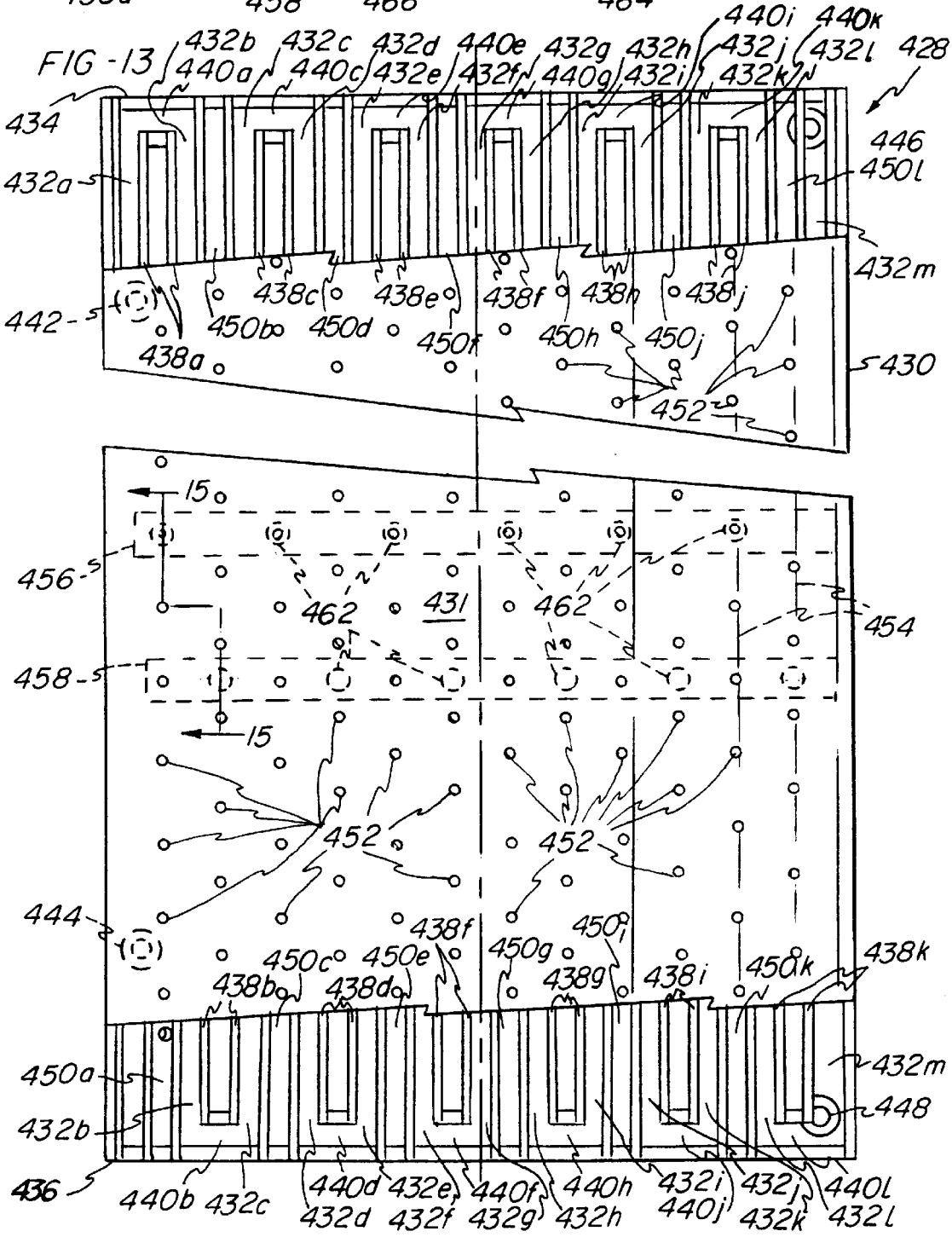
FIG. 13 is a partial top plan view of the preheater of FIG. 12.
Figure 14:
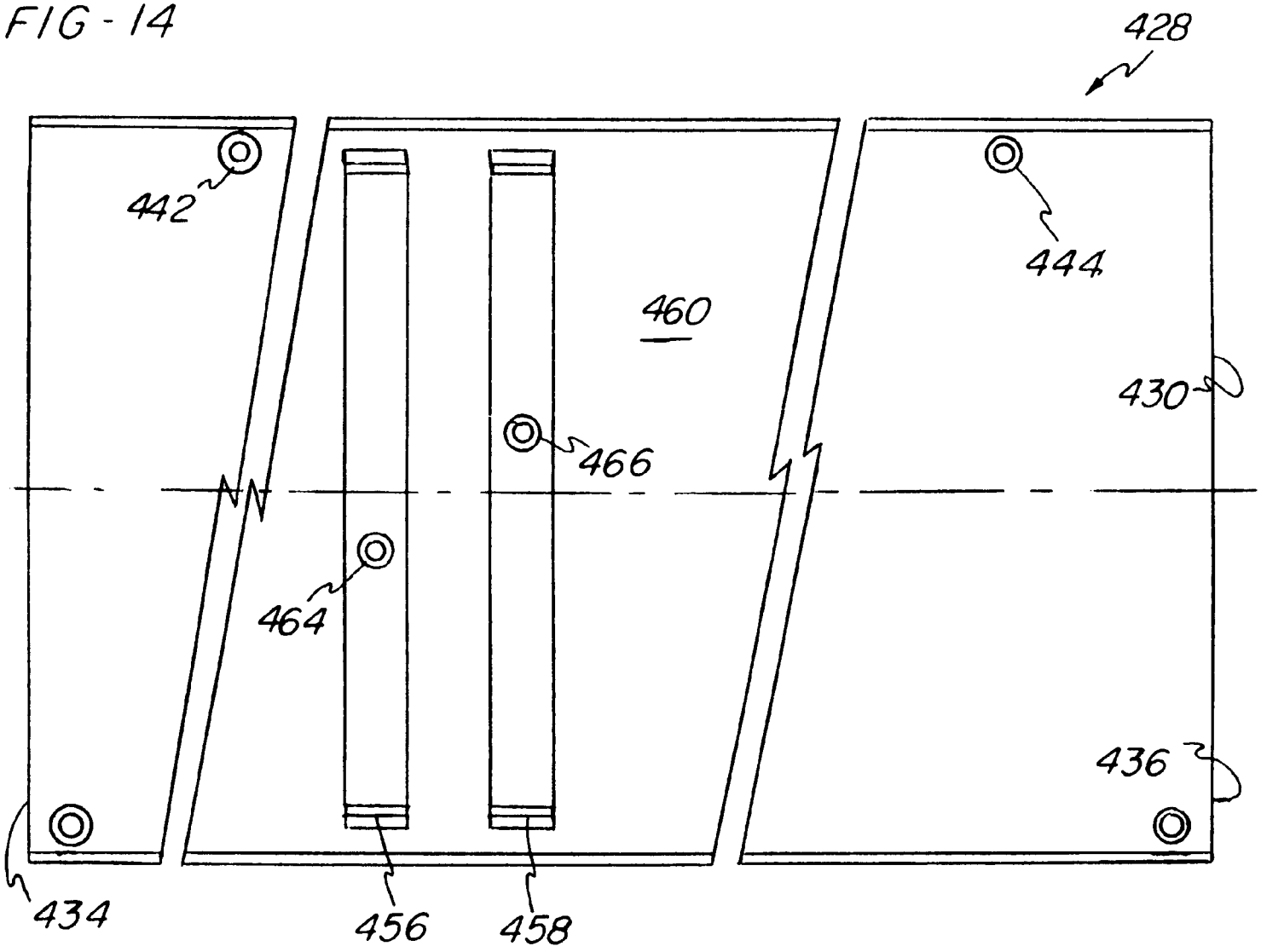
FIG. 14 is a partial bottom plan view of the preheater of FIG. 12.
Figure 15:
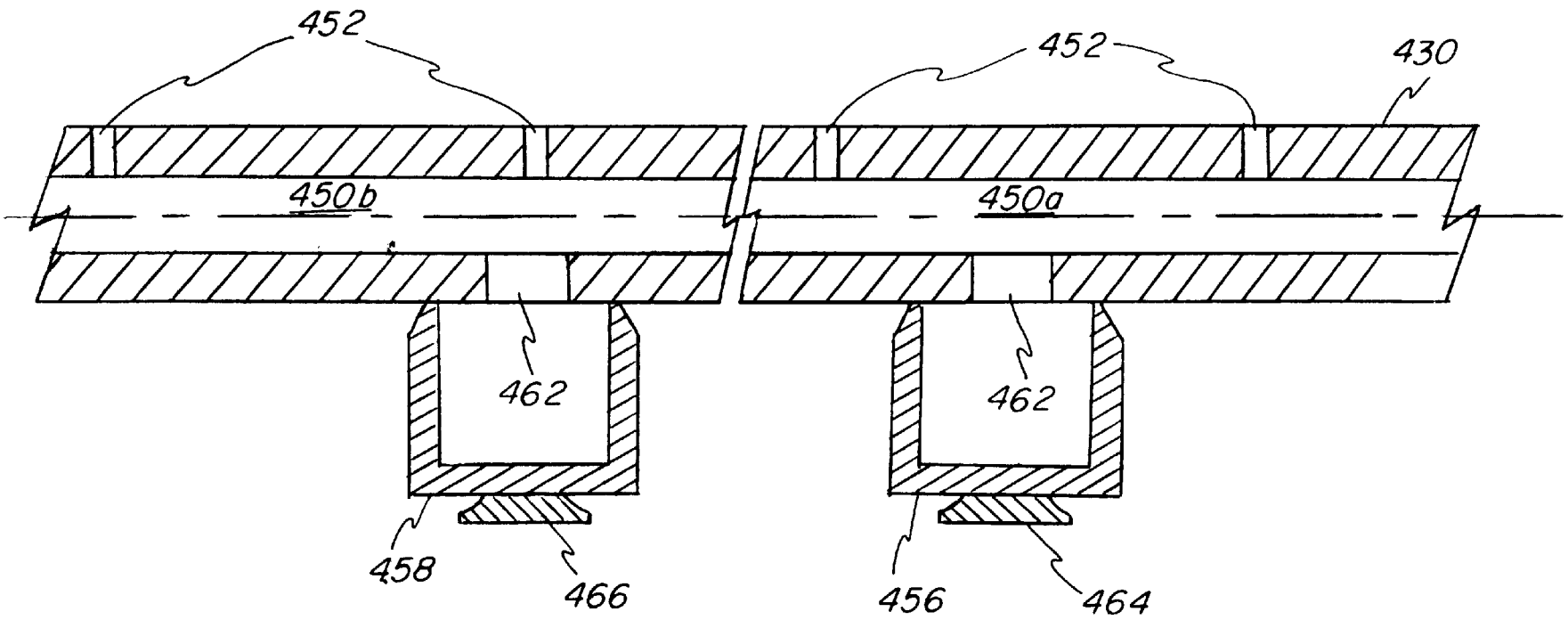
FIG. 15 is a cross-sectional view taken along line 15—15 of FIG. 13.

Referring further to FIG. 13, slot **440*a* is included proximate end face 434 to interconnect the first two primary channels 432*a* and 432*b*. At the opposite end face 436, slot 440*b* interconnects the second and third primary channels 432*b* and 432*c*. Each pair of adjacent primary channels 432 are interconnected at alternate ends to form a serpentine path through the plate 430**.

The heating plate 430 further includes a pair of first, or high pressure, steam inlet ports 442 and 444 located intermediate the end faces 434 and 436 to intersect with primary channel **432*a*. The plate 430 further includes a pair of first, or high pressure, condensate return ports 446 and 448 communicating with primary channel 432*m*. While typically only a single inlet port 442 or 444 and a single outlet port 446 or 448** will be utilized, two of each are provided to facilitate flexibility in interconnecting with external piping arrangements.

The heating plate 430 further includes a plurality of secondary channels 450 extending between end faces 434 and 436 and located within the wall 438 intermediate each primary channel 432. The secondary channels 450 are cylindrical in nature and each secondary channel 450 is sealed from direct communication with the other channels 432 and 450 in the plate 430. As with the primary channels 432, a particular secondary channel 450 will be referred to by a reference numeral in combination with a lowercase letter.

A plurality of outlet ports 452 are in fluid communication with the secondary channels 450 and extend outwardly into fluid communication with the arcuate surface 431. The outlet ports 452 are arranged in axially, or laterally, extending rows 454 extending in substantially parallel relation to the secondary channels 450. The outlet ports 452 of each row 454 are equally spaced from each other and intersect a single secondary channel 450. Each row 454 of the outlet ports 452 is longitudinally offset from each adjacent row 454 in a direction of travel of the medium web 24. As illustrated in FIG. 13, the outlet ports 452 of adjacent rows 454 are offset in the lateral direction to provide a substantially uniform steam distribution along the outer surface 431.

A pair of arcuate manifolds 456 and 458 are fixed, preferably by welding, to a lower surface 460 of the plate 430. Each secondary channel 450 includes a port 462 for providing communication between the secondary channel 450 and one of the manifolds 456 and 458. Alternating secondary channels 450 are in fluid communication with a single manifold 456 or 458. In other words, the secondary channels 450 are arranged in two distinct sets or groups, wherein each set of channels 450 is in fluid communication with one of the pair of manifolds 456 and 458. Each manifold 456 and 458 includes a second, or low pressure, steam inlet port 464 and 466 for supplying a low pressure steam to the secondary channels 450.

As may be appreciated, the low pressure steam supplied to the secondary channels 450 is released through the outlet ports 452 and produces a steam film in a manner as described above with reference to FIG. 9. The remaining operation of the single facer is identical to that described above with reference to FIG. 1.

While the forms of apparatus herein described constitute preferred embodiments of the invention, it is to be understood that the invention is not limited to these precise forms of apparatus, and that changes may be made therein without departing from the scope of the invention which is defined in the appended claims.

What is claimed is:

1. A heating device for a continuous paperboard web, said heating device comprising:

a thermally conductive cylindrical wall extending between opposing end faces and including a heated arcuate outer surface, said cylindrical wall defining a center axis;

at least one primary channel extending between said end faces and in thermal communication with said outer surface;

a plurality of outlet ports extending through said wall, said outlet ports sealed from said at least one primary channel and in fluid communication with said outer surface, said plurality of outlet ports arranged in a plurality of rows, each said row extending substantially parallel to said center axis and circumferentially offset from adjacent ones of said rows;

a first steam inlet port for supplying a first steam to said at least one primary channel;

a second steam inlet port for supplying a second steam to said plurality of outlet ports; and a steam film generated by said plurality of outlets ports, said steam film extending circumferentially in contact with at least a portion of said heated outer surface for supporting the paperboard web, thereby reducing frictional contact between the paperboard web and said heated outer surface.

2. The heating device of claim 1 further comprising an arcuate manifold providing fluid communication between said at least one second steam inlet port and said plurality of outlet ports.

3. The heating device of claim 1 wherein:

said first steam comprises a high pressure steam having a pressure between 150 psig and 200 psig; and said second steam comprises a low pressure steam having a pressure between 0.5 psig and 10 psig.

4. The heating device of claim 1 further comprising a plurality of secondary channels providing fluid communication between said at least one second steam inlet port and said plurality of outlet ports.

5. The heating device of claim 4 wherein said at least one primary channel comprises a plurality of primary channels interconnected to form a serpentine path proximate said heated surface of said cylindrical wall.

6. The heating device of claim 5 wherein:

said primary and secondary channels extend in substantially parallel relation to said center axis defined by said cylindrical wall; and adjacent pairs of said primary channels are interconnected at alternate ends of said primary channels.

7. The heating device of claim 6 wherein said secondary channels are circumferentially offset from said primary channels.

8. The heating device of claim 7 wherein said secondary channels are radially offset from said primary channels.

9. A heating device for a continuous web, said heating device comprising:

a thermally conductive curved plate extending between opposing end faces and having a heated arcuate outer surface;

at least one primary channel extending between said end faces and in thermal communication with said outer surface;

a plurality of outlet ports extending within said wall said outlet ports sealed from said at least one primary channel and in fluid communication with said outer surface, said plurality of outlet ports arranged in a plurality of laterally extending rows, each said row offset from adjacent ones of said rows;

at least one manifold in fluid communication with said plurality of outlet ports;

a first steam inlet port for supplying a first steam to said at least one primary channel;

a second steam inlet port for supplying a second steam to said at least one manifold; and a steam film generated by said plurality of outlet ports and in contact with said heated arcuate outer surface for supporting the web, thereby reducing frictional contact between the web and said heated arcuate outer surface.

10. The heating device of claim 9 further comprising a plurality of secondary channels providing fluid communication between said second steam inlet port and said plurality of outlet ports.

11. The heating device of claim 9 wherein:

said first steam comprises a high pressure steam having a pressure between 150 psig and 200 psig; and said second steam comprises a low pressure steam having a pressure between 0.5 psig and 10 psig.

12. The heating device of claim 9 wherein said at least one manifold comprises a first manifold communicating with a first set of said plurality of outlet ports and a second manifold communicating with a second set of said plurality of outlet ports.

13. A single facer comprising:

a forming corrugating roll;

a corrugating nip defined by said forming corrugating roll for corrugating flutes on a medium web;

a carrier corrugating roll operably connected to said forming corrugating roll for carrying the medium web into contact with a liner web; and a preheater positioned upstream from said corrugating nip, said preheater including an heated arcuate surface facing the medium web, a plurality of outlet ports in fluid communication with said heated surface, at least one primary channel in thermal communication with said arcuate surface, a first steam inlet port in fluid communication with said at least one primary channel for providing a first steam to said primary channels, and a second steam inlet port in fluid communication with said plurality of outlet ports for providing a second steam to said plurality of outlet ports.

14. The single facer of claim 13 further comprising a steam film generated by said plurality of outlet ports between said heated surface and the medium web thereby at least partially lubricating the medium web from frictional contact with said preheater.

15. The single facer of claim 13 further comprising a steam injector positioned intermediate said preheater and said corrugating nip for injecting steam against the medium web.

16. The single facer of claim 13 wherein said preheater further comprises a plurality of secondary channels in spaced relation to said primary channels and providing fluid communication between said second steam inlet port and said plurality of outlet ports.

17. The single facer of claim 13 wherein:

said first steam comprises a high pressure steam having a pressure between 150 psig and 200 psig; and said second steam comprises a low pressure steam having a pressure between 0.5 psig and 10 psig.

18. The single facer of claim 13 further comprising a first roller positioned upstream from said preheater and a second roller positioned downstream from said preheater, said first and second rollers for guiding the medium web in an arcuate path around said heated surface.

19. The heating device of claim 1 further comprising:

a pressing device;

a bonding nip defined by said pressing device for bringing the paperboard web into adhering contact with a second paperboard web; and wherein said heated outer surface is positioned upstream from said bonding nip for preheating one of the webs prior to entering said bonding nip.

20. The heating device of claim 9 further comprising:

a pressing device;

a bonding nip defined by said pressing device for bringing the web into adhering contact with a second web; and wherein said heated outer surface is positioned upstream from said bonding nip for preheating one of the webs prior to entering said bonding nip.

* * * * *